US005282900A

United States Patent [19]

McDonell et al.

[11] Patent Number: 5,282,900

[45] Date of Patent: Feb. 1, 1994

[54] NONWOVEN SURFACE TREATING ARTICLES, SYSTEM INCLUDING SAME, AND METHOD OF TREATING CALCIUM CARBONATE-CONTAINING SURFACES WITH SAID SYSTEM

[75] Inventors: James A. McDonell, Woodbury; Robert C. Kyle, Minneapolis, both of Minn.

[73] Assignee: Minnesota Mining and Manufacturing Company, St. Paul, Minn.

[21] Appl. No.: 853,919

[22] Filed: Mar. 19, 1992

[51] Int. Cl.[5] ..... A47L 11/164; A47L 13/16; B24D 11/00; B24D 13/14; B32B 5/28

[52] U.S. Cl. ..... 134/2; 15/209.1; 15/230.12; 51/295; 51/400; 134/3; 134/26; 134/28; 428/85; 428/87; 428/96; 428/97; 428/283; 428/288; 428/290; 428/361; 428/362; 428/543

[58] Field of Search ..... 15/230.12, 209.1; 51/295, 400; 134/2, 3, 26, 28; 428/85, 87, 96, 97, 283, 288, 290, 361, 362

[56] References Cited

U.S. PATENT DOCUMENTS

| | | | |
|---|---|---|---|
| 2,931,089 | 4/1960 | Evans . | |
| 2,958,593 | 11/1960 | Hoover et al. . | |
| 3,537,121 | 11/1970 | McAvoy . | |
| 3,595,738 | 7/1971 | Clarke et al. . | |
| 3,619,874 | 11/1971 | Li et al. | 28/1.5 |
| 3,781,172 | 12/1973 | Pett | 51/309 |
| 3,868,749 | 3/1975 | Cate | 28/72.15 |
| 3,891,408 | 6/1975 | Rowse et al. | 51/295 |
| 3,893,826 | 7/1975 | Quinan et al. | 51/295 |
| 4,176,420 | 12/1979 | Magid | 15/230 |
| 4,314,827 | 2/1982 | Leitheiser et al. | 51/298 |
| 4,505,720 | 3/1985 | Gabor | 51/295 |
| 4,518,397 | 5/1985 | Leitheiser et al. | 51/293 |
| 4,574,003 | 5/1986 | Gerk | 51/309 |
| 4,738,876 | 4/1988 | George et al. | 427/299 |
| 4,744,802 | 5/1988 | Schwabel | 51/309 |
| 4,756,766 | 7/1988 | Thrower | 134/3 |
| 4,770,671 | 9/1988 | Monroe | 51/293 |
| 4,881,951 | 11/1989 | Wood et al. | 51/309 |
| 4,893,439 | 1/1990 | McAvoy et al. | 51/400 |
| 4,898,598 | 2/1990 | Zapata | 51/305 |
| 5,030,496 | 7/1991 | McGurran | 428/85 |
| 5,082,720 | 1/1992 | Hayes | 428/224 |

FOREIGN PATENT DOCUMENTS 88 02995 9/1989 France .

OTHER PUBLICATIONS

Kirk-Othmer, *Encyclopedia of Chemical Technology*, 3rd Ed., vol. 14., John Wiley & Sons (1981) pp. 343-352.

Batiment Entretien, "Brilliant Marble: is it easy to obtain?", Jan.-Feb. (1990).

Batiment Entretien, "Crystallization of Marble Stone", Jan.-Feb. (1985) (English translation).

"Instrucciones Generales Para Cristalizar con Maquinas Y Productos Kleever", Coor & Kleever, S.A., Barcelone, Spain, p. 6 (partial translation).

Hoechst Celanese Corporation, *Bulletin*, "Vitrification Treatment for Stone Floors Formula JS342/9" (Published 1988).

"Raising Standards for the 90's", *Cleaning & Maintenance Magazine*, May-Jun. 1990, p. 10.

American National Standard for Frading of Certain Abrasive Grain on Coated Abrasive Material (ANSI ASC B74.8-1984).

Kirk-Othmer, *Encyclopedia of Chemical Technology*, 3rd Ed., vol. 17, John Wiley & Sons (1981) pp. 384-399.

*Primary Examiner*—James C. Cannon

*Attorney, Agent, or Firm*—Gary L. Griswold; Walter N. Kirn; Jeffrey L. Wendt

[57] ABSTRACT

A nonwoven surface treating article suitable for treating surfaces which include calcium carbonate, such as marble floors, includes an open, lofty, three-dimensional nonwoven web of a plurality of thermoplastic organic fibers, a binder, and abrasive particles having an average particle diameter ranging from about 0.1 micrometer to about 30 micrometers. The abrasive articles of the invention do not rust, as do steel wool pads, and produce a high gloss, durable surface. A system for treating calcium carbonate-containing surfaces is also presented, the system including the articles and an acidic crystallization agent. Methods of treating calcium carbonate-containing surfaces with the system are also presented.

19 Claims, No Drawings

NONWOVEN SURFACE TREATING ARTICLES, SYSTEM INCLUDING SAME, AND METHOD OF TREATING CALCIUM CARBONATE-CONTAINING SURFACES WITH SAID SYSTEM

FIELD OF THE INVENTION

This invention relates to nonwoven surface treating articles which are useful for treating stone surfaces, particularly marble floors.

BACKGROUND OF THE INVENTION AND RELATED ART

Marble is a crystalline rock which, if pure, would be composed entirely of carbonate of lime (calcium carbonate, $CaCo_3$, the original material of limestone). It is a rock valued for its beauty and is widely used for making statuary and monuments, for architectural treatment in construction, and for ornamentation. Many limestones which become decorative when polished are also termed marbles. Limestone assumes a bewildering number of widely divergent physical forms, including marble, travertine, chalk, etc. Limestone is also generally classified in the following types: "high calcium", in which the carbonate content is essentially calcium carbonate with no more than 5 percent magnesium carbonate (usually less); "magnesian", which contains both carbonates, with a magnesium carbonate content of about 5 to 20 percent; and "dolomitic", which contains over 20 percent magnesium carbonate but not more than 45.6 percent magnesium carbonate, with the balance calcium carbonate. Individual limestone types are further described by many common names, as detailed in Kirk & Othmer, *Encyclopedia of Chemical Technology.* Third Edition, Vol. 14, John Wiley & Sons (1981), pages 343–352.

Marble is a common term for a metamorphic, highly crystalline rock that may be high-calcium or dolomitic limestone of varying purity. It occurs in virtually every color in diverse mottled effects and is the most beautiful form of limestone. It is usually very hard and can be cut and polished to a very smooth surface.

It is known that calcium carbonate-containing stone surfaces, such as marble floors, may be maintained in a variety of ways. It is convenient to identify three categories of treatment: (1) polishing or crystallizing (vitrification) of the stone surface with a pad of material, usually in combination with polishing agents; (2) application of chemicals which penetrate the stone surface, thereby sealing it against staining and, hopefully, improving its appearance, followed by or combined with polishing of the sealed stone surface; and (3) application of film-forming compositions to the stone surface to seal and protect it from staining and abrasion. In the latter method, polishing of the film surface is typically part of the maintenance procedure. This invention relates to treating the stone surface, as in (1) above, with novel nonwoven abrasives. Although a marble floor is used herein to exemplify the calcium carbonate-containing stone surface, the invention is applicable to calcium carbonate-containing stone surfaces in general.

The gloss produced by buffing a marble floor with an abrasive article attached to a conventional rotary floor machine depends on a number of factors. Among these are the type of abrasive article employed, the nature and amount of ancillary chemical used (if at all) with the abrasive article, the pressure applied to the floor, the speed of rotation of the abrasive article, the treatment time at given pressure, etc. To ensure acceptable gloss production as a result of the treatment procedure,.the user tries to optimize all of these parameters. The goal is a high gloss, high durability, stain resistant floor, achieved with a minimum of labor.

A newly installed marble floor is typically honed with coarse abrasives followed by a series of increasingly finer abrading materials in order to smooth the originally installed floor, to remove lippage, and eventually to produce a smooth, level surface with a satin sheen. Further mechanical polishing with increasingly finer grades of diamond abrasives will ultimately yield a very high gloss.

A honed floor requires only dusting and wet-mopping to maintain its appearance. However, a honed marble floor will have little or no resistance to staining insofar as the surface is naturally porous and no protective coating has been applied. In addition, the appearance of the honed floor, as indicated by "shininess", or "gloss", will typically be low. Even if the floor has been further polished with diamond abrasives to produce a very high gloss, the surface of the marble is still subject to rapid deterioration of gloss due to the abrasion of foot or other traffic, and the stain resistance of the surface is not improved.

In one traditional method of treating marble to achieve higher gloss and durability, an acid-containing composition is buffed onto the marble using a weighted rotary floor machine under which has affixed thereto a buffing pad comprising steel wool. This method is commonly referred to as "crystallization" or "vitrification" of the surface (the former sometimes being associated with the use of a fluorosilicate salt in the acidic composition). It is generally believed by those skilled in the art that the interaction of the acid, steel wool, and pressure-generated frictional heat from the weighted machine combine to alter the chemical composition of the marble surface to produce a harder and therefore more durable surface: one which can be polished to a higher gloss, and one which has improved stain resistance.

*Batiment Entretien,* "Brilliant Marble: is it easy to obtain? "]Jan–Feb, 1990 (English translation from French publication) states "Thus it is that, by the intermediary of an acid and a catalyst (iron), a physico-chemical reaction transforms the calcium carbonate into calcium fluoride and magnesium fluoride." This publication also describes in detail the process and equipment necessary to prepare and crystallize marble floors including steel wool pads and ancillary abrasive agents. *Batiment Entretien,* "Crystallization of Marble Stone," Jan–Feb, 1985, (English translation from French publication) is an earlier version of the same publication and it makes the same statements with respect to the necessity of steel wool for crystallizing the floor.

"Instrucciones Generales Para Cristalizar con Maquinas Y Productos Kleever", instructions for crystallizing marble floors (partially translated from Spanish), publication date unknown by Coor & Kleever S.A., Barcelona, Spain, states that steel wool is "indispensable" for use with its crystallizing agent (page 6), and other materials will not produce good results.

U.S. Pat. No. 4,738,876 (George, et al.), refers to a two-step crystallization method which comprises applying an acid conditioning composition as a primer with a "stripping grade pad", followed by application of a hexafluorosilicate salt crystallizing agent which is preferably applied and buffed with a wire wool (steel wool) pad in (column 6, line 57).

U.S. Pat. No. 4,756,766 (Thrower) describes a coating, cleaning, and conditioning process for marble which includes the use of a fluorosilicate composition and preferably a steel wool pad (column 2, lines 25–68 to column 3, lines 1–30). This reference also includes some postulated chemistry.

Hoechst Celanese Corp. (Somerville, N.J.), in a publication entitled "Bulletin: Vitrification Treatment for Stone Floors Formula JS 342/9", (published 1988), describes vitrification as "a one step procedure for the polishing of marble... floors." The vitrification formula known under the trade designation "JS 342/9" as described in the bulletin comprises a wax, a surfactant, an aluminum salt, an organic acid, and water. The vitrification formula is recommended to be buffed onto the floor with a low-speed machine (150 rpm) and a steel wool pad. Hoechst Celanese Corp. publication "Floor Polish Bulletin: Crystallization Treatment for Stone Floors, Formulation FA 1401", (published 1985), describes crystallization as "a one step procedure for polishing marble, terrazzo and hydraulic mosaic stone floors." The formulation comprises a water dispersion of magnesium silicofluoride, a surfactant, a nonyphenol with 10 moles of ethylene oxide, an organic acid, and a wax. The composition is to be buffed onto the floor with a steel wool pad.

Another cleaning industry publication, "Raising Standards for the 90's", *Cleaning & Maintenance Magazine;* June 1990, p.10, describes the use of wire wool pads with vitrification chemicals. Additionally, the technical literature of several major marble floor maintenance supply companies specify that steel wool pads be used with their treatment chemicals.

The use of steel or other wire wool pads has several disadvantages in marble maintenance. Slivers of steel wool shred from the pad during use and remain on the floor unless removed. These slivers quickly rust, discoloring the floor. Unless they are quickly and completely removed from the floor after the polishing procedure has been accomplished, rust spots will form, a particularly problematic stain on marble. Once the steel wool pad has been used, it also begins to rust and therefore cannot be stored for future use. Steel wool can be difficult to handle insofar as it tends to leave slivers in the skin of those handling it (in many cases, the pads are hand-made by the user from steel wool stock); and when in use as a pad on the floor, it tends to ball up or pull apart thus rendering the pad unfit for continued polishing even though much of the original steel wool remains on the pad. This tendency to shred, ball up, and pull apart is greater with finer (less lofty, more dense) grades of steel wool. Because of this, even though the finer grades of steel wool (such as #0000 or #00) are expected to produce a more brilliant gloss on the floor, typically the medium or fine grades (such as #0 or #1) are recommended for use in maintaining marble floors. U.S. Pat. No. 2,958,293 (Hoover, et al.) discusses the use and disadvantages of steel wool pads quite adequately.

Attempts have been made to improve on steel wool pads. For example, stainless steel wool pads have been used in order to prevent or retard rusting of the pad. Stainless steel wool pads, however, are more expensive than plain carbon steel wool pads, are no less difficult to handle, and have the same tendency to shred or ball up in use.

French patent application 88 02995 (Philippeau, published Sep. 4, 1989) describes an improved pad made from woven stainless steel fibers to be used for polishing marble.

U.S. Pat. No. 4,176,420 (Magid) describes a pad made from a continuous ribbon of stainless steel which is used for routine floor maintenance and which eliminates rusting, shredding, and linting associated with steel wool pads. No utility with respect to marble is taught or suggested.

In another known class of methods of treating marble, a liquid acid composition and a particulate abrasive material are mixed to form a slurry and slurried onto the floor. Polishing is accomplished by buffing the slurry onto the floor with a rotary floor machine to effect simultaneously a polishing action and a slight dissolution of the calcium carbonate in the marble by the acid in order to produce a smooth, high gloss surface. Pads used in this class of methods traditionally have been made of a number of materials including felts and pads made from synthetic nonwoven fibers.

U.S. Pat. No. 4,738,876, mentioned above, in disclosing a two-step process for crystallizing stone floors, refers to the use of an abrasive synthetic pad for application of the primer (claim 15). Review of the specification does not reveal a specific synthetic fiber for the abrasive synthetic pad, referring only to "black", "tan", and other color abrasive synthetic pads (Examples). Patentees admit that the pad composition is a non-critical aspect of their invention (column 6, lines 12–14).

U.S. Pat. No. 4,756,766, also mentioned above, describes a cleaning step using an abrasive composition buffed into the floor with a nylon pad (column 2, line 5).

U.S. Pat. No. 4,898,598 (Zapata) refers to the use of a "felt" pad for polishing marble in conjunction with a polishing compound (column 4, line 34). No specifics are given as to the composition of the felt.

One disadvantage of the slurry procedures is that the slurry can be spattered onto surrounding surfaces, such as walls and baseboards, by the rotating pad of the floor machine, creating an undesirable task of having to wipe clean the spattered slurry from walls and baseboards. Another disadvantage is that the pad may become clogged with the abrasive slurry and detritus from the floor, which may result in diminished abrasive effectiveness on the floor. Yet another disadvantage is that the proper amount of abrasive slurry must be maintained on the floor for proper polishing action even though the slurry is being moved away from the area intended to be polished by the rotary motion of the pad.

Uniform, lofty, open, nonwoven three-dimensional abrasive articles are known for use in cleaning and polishing floors and other surfaces. Examples of such nonwoven surface treating articles are the nonwoven abrasive pads made according to the teachings of Hoover, et al., mentioned above; McAvoy, U.S. Pat. No. 3,537,121; and McAvoy, et al., U.S. Pat No. 4,893,439. Hoover et al. describe such nonwoven pads as comprising > many interlaced randomly disposed flexible durable tough organic fibers which exhibit substantial resiliency and strength upon prolonged subjection to water and oils. Fibers of the web are firmly bonded together at points where they intersect and contact one another by globules of an organic binder, thereby forming a three-dimensionally integrated structure. Distributed within the web and firmly adhered by binder globules at variously spaced points along the fibers are abrasive particles.

Hoover, et al., at column 2, lines 61–70, column 3, line 1.

These nonwoven pads have been and are available in a wide range of abrasive quality from very coarse pads for gross removal of surface treatments (stripping or scouring pads containing, for example, as in Example I of Hoover, et al., 180 grit silicon carbide abrasive particles) to very finely abrasive or nonabrasive polishing pads (containing, for example, as in Example II of Hoover, et. al., 180 grit and finer flint fines, applied at about half the weight of the silicon carbide of Example I).

McAvoy, et al. '439 note that the abrasive particle grade can range from about 36 to about 1000, depending on the application. According to "American National Standard for Grading of Certain Abrasive Grain on Coated Abrasive Material" (ANSI ASC B74.18-1984), grade 36 corresponds to a screen aperture size of about 800 micrometers. The highest grade (smallest screen aperture size) given in the standard is grade 220, which has a "fines" sieve size listed as 64 micrometers. Particles corresponding to grade 1000 are apparently much smaller in size, having average particle diameter of about 10 micrometers. McAvoy, et al., do not, however, mention any abrasive particle size as critical within the range of 36 to 1000 grade abrasive particles, and do not teach or suggest which grades are preferred for maintaining various floor compositions.

U.S. Pat. No. 5,030,496 (McGurran) describes nonwoven fibrous surface treating articles. As noted in column 5 , lines 61–68, useful abrasive particles may range in size anywhere from about 24 grade, average particle diameter of about 0.71 mm (or 710 micrometers), to about 1,000 grade, average particle diameter of about 0.0 mm (i.e., about 10 micrometers). No criticality is given to the average particle diameter nor is any attention given to crystallizing marble or other calcium carbonate-containing surfaces.

U.S. Pat. No. 5,082,720 (Hayes) describes melt-bondable fibers for use in nonwoven webs, including nonwoven abrasive webs which may include abrasive grains having grade ranging from about 36 to about 1000. However, as with the Hoover, et al., and McAvoy, et al., and McGurran patents no criticality is given to abrasive particle size or crystallization of calcium carbonate-containing surfaces.

Nonwoven abrasive pads such as disclosed by Hoover, et al., and McAvoy, et al., and McGurran, while finding wide ranging use, by themselves have not been suitable for polishing or crystallizing marble floors. This is clear from the continued and persistent use of non-abrasive-filled nonwoven pads in combination with an ancillary abrasive agents (such as abrasive slurries) for polishing marble, or the use of steel wool pads alone for crystallizing marble floors by those skilled in the art of marble floor maintenance.

Thus it was surprising to find that the articles of the present invention, comprising a uniform, lofty, open, nonwoven three-dimensional web, having very fine abrasive particles adhered to many interlaced randomly disposed flexible durable tough organic fibers, when used with ancillary acidic crystallization agents, crystallized marble and other calcium carbonate-containing surfaces equally or better than previously known materials, without the aforementioned problems associated with steel wool pads. A further advantage is that a high gloss may be obtained faster with the systems of the present invention than with systems known in the art, thus reducing the amount of labor required to achieve the desired appearance level of the marble system. Another advantage is that the nonwoven surface treating articles of the present invention contain no ferrous metal component: they will not shred into fine pieces and rust on the floor, nor will they rust during storage after having been used.

SUMMARY OF THE INVENTION

This invention provides a lofty, durable, low density surface treating article which comprises a nonwoven web coated with a suitable binder resin containing microabrasive particles. The article of this invention is particularly suited for the polishing of marble surfaces, specifically, floors. While it is well-known to manufacture similar abrasive articles for floor maintenance utilizing a variety of fibers, resin coatings and abrasive fillers, the article of this invention is characterized by the use of abrasive particles of a specific size, namely those having average particle size ranging from about 0.1 micrometer to about 30 micrometers.

Thus, one aspect of the invention is a nonwoven surface treating article suitable for treating surfaces comprising calcium carbonate, the article comprising an open, lofty, three-dimensional nonwoven web comprising a plurality of thermoplastic organic fibers, a binder which adheres the fibers at points of mutual contact, and abrasive particles adherently bonded to the fibers by the binder, the abrasive particles having an average particle diameter ranging from about 0.1 micrometer to about 30 micrometers.

Another aspect of the invention is a system for polishing and/or crystallizing stone surfaces comprised of calcium carbonate, such as marble floors, the system comprising:

(a) the abrasive article of the invention described herein; and (b) an acidic crystallization agent, capable of reacting with the calcium in the stone surface comprised of calcium carbonate, to produce an insoluble calcium salt.

A further aspect of the invention is a method of treating calcium carbonate-containing surfaces, the method including the steps of (a) applying an acidic crystallization agent, either to a stone surface comprised of calcium carbonate or to a nonwoven surface treating article, or both, wherein the nonwoven surface treating article comprises an open, lofty, three-dimensional nonwoven abrasive web comprising a plurality of thermoplastic organic fibers, a binder, and abrasive particles having an average particle diameter ranging from about 0.1 micrometer to about 30 micrometers; and (b) contacting said nonwoven surface treating article with the calcium carbonate-containing surface, in the presence of the acidic crystallization agent, while causing relative movement between the surface and the article, thereby producing a durable, high gloss surface on the surface comprising calcium carbonate.

Preferred are those methods wherein the crystallization agent is in liquid form and sprayed onto the surface comprised of calcium carbonate and/or the nonwoven surface treating article of the invention prior to step (b).

Further aspects and advantages of the invention will become apparent from the description which follows.

DESCRIPTION OF PREFERRED EMBODIMENTS

Abrasive Particles

The size of the abrasive particles incorporated into the nonwoven surface treating articles of the invention is a critical aspect of the invention. Experiments with commercially available coated abrasive materials (such as very fine grades of sandpaper or loose abrasive particles) revealed that abrasive materials which were made using abrasive particles having average particle size of 30 micrometers or finer were especially effective at producing a high gloss (i.e., a glossmeter reading of 75 or greater using a 60° glossmeter geometry, in accordance with American Society of Testing Materials D-523) on a marble surface. Coarser grades of abrasive material failed to produce a high gloss.

In order to investigate the effect of, and determine the most preferred, abrasive particle size for the polishing of marble, samples of commonly available coated abrasive materials ("sandpaper") containing abrasive particles having average particle sizes ranging from 30 micrometers to less than 10 micrometers were made suitable for attachment to the Schiefer tester described in Test Procedures. 10.2 cm diameter discs of the abrasive material were adhered to 10.2 cm diameter discs of backing material known under the trade designation "3M Carpet Pad", available from Minnesota Mining and Manufacturing Company, St. Paul, Minn. ("3M") which was used solely as a backing material for the abrasive disc. Pads of steel wool and a commercially available nonwoven white (talc containing) pad, known under the trade designation "Scotch-Brite Super Polish Pad" (also from 3M) were tested for comparison.

White Calcutta marble tile samples were smeared with a commercially available, aqueous, magnesium fluorosilicate crystallizing solution, (trade designation "Kleever K2"), as described in the Test Methods section below. (0.2 g was used in this investigation instead of 0.4 g as shown in the Test Methods section.). Four test periods (500 cycles per period) on the Schiefer machine were completed for each marble tile sample.

When the paper-backed coated abrasive material (known under the trade designation "Imperial", from 3M) contained 30 micrometer average particle size aluminum oxide abrasive particles, the 60° glossmeter value was low even after four test periods.

The following paper-backed coated abrasives were also tested:

1. a 25 micrometer average particle size silicon carbide coated abrasive (known under the trade designation "Imperial Wet-or-Dry");
2. a 12 micrometer average particle size aluminum oxide coated abrasive (trade designation "Yellow Fining Pad");
3. a 12 micrometer average particle size aluminum oxide bead coated abrasive (containing resin-coated particles, known under the trade designation "CSF Gold Qwik-Strip"); and
4. 9 micrometer and 3 micrometer average particle size aluminum oxide abrasive particle-containing, coated abrasives (trade designation "Finesse Wet-or-Dry Production Polishing Paper") (all from 3M).

Initial gloss production was moderate for each of 1–4 above (one test period), while a very high (i.e., much greater than 75 at 60° glossmeter geometry) final gloss was achieved for each of 1–4 (after four test periods).

The nonwoven white pad mentioned above and a #3 steel wool pad yielded low initial and moderate final gloss whereas finer grades of steel wool (#0 , #00, and #0000) produced moderate initial gloss and high final gloss.

Thus it appeared that steel wool was not necessary, contrary to the teaching of the current literature, to produce the high gloss appearance. Rather, the abrasive particle size appeared to be one critical feature to obtaining high gloss on a calcium carbonate-containing surface with a nonwoven surface treating article, an aspect not taught or suggested heretofore.

A secondary aspect of the invention is the durability of the high gloss surface produced. It is not sufficient that marble floors have high gloss; they must also have high durability or be "crystallized", by forming a hard surface of $CaF_2$ or other insoluble calcium salt surface over the base surface.

In order to test the durability of the high gloss marble tile surfaces generated in the polishing test just described, these same tiles were subjected to a durability test (the Gardner durability test is described below under "Test Methods") in which a 10 weight percent tap water solution of calcium carbonate (trade designation "Gammasperse 960") was used as an abrasive medium on a standard abrasion tester (trade designation "Gardner Abrasion Tester", available from Pacific Scientific). Durability was measured by the change in gloss of the high gloss surfaces before and after the durability test. The less change in glossmeter reading, the more "durable" the surface on the marble test tile. A loss of glossmeter reading of 25 or less indicated an acceptable value for durability.

The samples crystallized with 30 and 25 average particle size micrometer paper-backed coated abrasives, respectively, lost approximately 40–50 units of their original glossmeter reading after four 50 cycle test periods on the abrasion tester. The samples crystallized with 12, 9 or 3 micrometer average particle size paper-backed coated abrasives, and the sample crystallized using the #0 steel wool lost only 20–25 units of their initial glossmeter reading after four 50 cycle tests.. This test indicated that the degree of crystallization of the marble (as evidenced by loss of gloss) was equivalent whether steel wool or a microabrasive material was used to polish the surface. These results were in direct contradiction to the current teaching that iron is required as a catalyst for the crystallization process.

Finally, a comparison of the paper-backed coated abrasives' 1–4 and the 30 micrometer paper-backed coated abrasive (known under the trade designation "Imperial") abrading ability was made on an actual marble floor in order to corroborate the above results. "Floor pads" were prepared by attaching 12.7 cm diameter circular discs of the paper-backed coated abrasive materials with a suitable adhesive compound to a 43.2 cm diameter carpet pad holder (trade designation "3M Carpet Pad") in a radial fashion so as to cover the surface of the carpet pad. Testing was performed on a 30.5 cm ×30.5 cm ×0.95 cm white Calcutta marble tile removably positioned in a marble floor made of similar size tiles.

Initially, the test tile surface was conditioned by abrading the surface with an abrasive disc containing 120 grade (about 170 micrometer and finer) silicon carbide abrasive particles (trade designation "Scotch-Mesh", from 3M) in order to dull the surface of the marble. Then aqueous, fluorosilicate crystallizing solution (trade designation "Kleever K2" available from Coor & Kleever, S.A., Barcelona, Spain (herein after "Kleever")), 6–7 grams, was smeared onto each test tile. The prepared carpet pad bearing the coated abrasive samples was attached to a rotary electric floor machine, and each tile was buffed at 175 rpm as would normally be done by those skilled art of marble maintenance. Each buffing session lasted two minutes after which the tile was wiped clean and gloss was measured at ten different locations on each tile, in accordance with ASTM D-523. The average of these was recorded. This process of applying the crystallizing agent solution, buffing, and measuring gloss was repeated several times for each sample. After four such cycles, the #0 steel wool produced a high gloss on the marble surface whereas the coated abrasive containing 3 micrometer average particle size abrasive particles yielded comparable gloss after only two cycles. Not only did the coated abrasive sample yield gloss production on the floor equivalent to the steel wool sample, but it did so more rapidly, which translates into labor and dollar savings during actual maintenance operations.

Whereas the deficiencies of steel wool pads and nonwoven pads in combination with ancillary loose abrasive slurries were noted above, it should also be mentioned that the paper-backed coated abrasive discs used in the testing just described were not suitable for extended use. The majority of the test samples became unusable after four cycles on the Schiefer machine or after about ten minutes on the floor machine. These microabrasive discs became loaded with detritus, lost adhesion to the backing, or transferred adhesive to the floor within a relatively short time of use.

Thus, in the preferred embodiment of this invention, the nonwoven web is coated with a binder precursor solution comprising a resin in latex form, and microabrasive particles (i.e., abrasive particles having average particle diameter less than about 30 micrometers but greater then about 0.1).

Abrasive particles are preferably dispersed throughout and adhered to the fibers of the three-dimensional nonwoven web by the resins of the binders described below. Abrasive particles useful in the nonwoven surface treating articles of the present invention may be individual abrasive grains or agglomerates of individual abrasive grains.

The abrasive particles may be of any known abrasive material commonly used in the abrasives art having a hardness greater than that of marble. The CRC "Handbook of Chemistry and Physics", 61st Ed., 1980/81 p. F24 lists marble hardness =3–4 Mohs; talc =1 Moh; garnet =7 Mohs; aluminum oxide =9+Mohs; and silicon carbide =9+Mohs.

Preferably, the abrasive particles have a hardness of about 6 Mohs or greater. Examples of suitable abrasive particles include individual silicon carbide abrasive grains (including refractory coated silicon carbide abrasive grains such as disclosed in U.S. Pat. No. 4,505,720), fused aluminum oxide, heat treated fused aluminum oxide, alumina zirconia (including fused alumina zirconia such as disclosed in U.S. Pat. Nos. 3,781,172; 3,891,408; and 3,893,826, commercially available form the Norton Company of Worcester, Mass., under the trade designation "NorZon"), cubic boron nitride, garnet, pumice, sand, emery, mica, corundum, quartz, diamond, boron carbide, fused alumina, sintered alumina, alpha alumina-based ceramic material (available from Minnesota Mining and Manufacturing Company (3M), St. Paul, Minn., under the trade designation "Cubitron"), such as those disclosed in U.S. Pat. Nos. 4,314,827; 4,518,397; 4,574,003; 4,744,802; 4,770,671; and 4,881,951, and combinations thereof.

The abrasive particles are preferably present in a coatable binder precursor solution (containing water and/or organic solvent, latex or other resin, abrasive particles, and other ingredients) at a weight percent (per total weight of coatable solution) ranging from about 10 to about 65 weight percent, more preferably from about 40 to about 60 weight percent.

The abrasive particles are not required to be uniformly dispersed on the fibers of the nonwoven articles, but a uniform dispersion may provide more consistent abrasion characteristics.

Nonwoven Webs

The open, lofty, nonwoven surface treating articles of the present invention are preferably made from crimped, staple, thermoplastic organic fibers such as polyamide and polyester fibers. Although crimping is not necessary to the invention, crimped, staple fibers can be processed and entangled into nonwoven webs by conventional web-forming machines such as that sold under the tradename "Rando Webber" which is commercially available from the Curlator Corporation. Methods useful for making nonwoven webs suitable for use in the invention from crimped, staple, synthetic fibers are disclosed by Hoover, et al., in U.S. Pat. Nos. 2,958,593 and 3,537,121, which are incorporated herein by reference. Continuous crimped or uncrimped fibers may also be used, but these tend to increase frictional drag of the article.

The staple fibers may be stuffer-box crimped, helically crimped as described, for example, in U.S. Pat. No. 4,893,439, or a combination of both, and the nonwoven webs useful in making nonwoven surface treating articles of the invention may optionally contain up to about 50 weight percent melt-bondable fibers, more preferably from about 20 to about 30 weight percent, to help stabilize the nonwoven web and facilitate the application of the coating resin.

Suitable staple fibers known in the art are typically made of polyester or polyamide, although it is also known to use other fibers such as rayon.

Melt-bondable fibers useful in the present invention can be made of polypropylene or other low-melting polymers such as polyesters as long as the temperature at which the melt-bondable fibers melt and thus adhere to the other fibers in the nonwoven web construction is lower than the temperature at which the staple fibers or melt-bondable fibers degrade in physical properties. Suitable and preferable melt-bondable fibers include those described in U.S. Pat. No. 5,082,720, mentioned above. Melt-bondable fibers suitable for use in this invention must be activatable at elevated temperatures below temperatures which would adversely affect the helically crimped fibers. Additionally, these fibers are preferably coprocessable with the helically crimped fibers to form a lofty, open unbonded nonwoven web using conventional web forming equipment. Typically, melt-bondable fibers have a concentric core and a sheath, have been stuffer box crimped with about 6 to about 12 crimps per 25 mm, and have a cut staple length of about 25 to about 100 mm. Composite fibers have a tenacity of about 2–3 g/denier. Alternatively, melt-bondable fibers may be of a side-by-side construction or of eccentric core and sheath construction.

The preferred fibers of this invention are helically crimped polyester staple fibers in combination with a low-melting polyester melt-bondable fiber. Particularly preferable are helically crimped polyethylene terephthalate (PET) fibers.

U.S. Pat. No. 3,595,738, incorporated herein by reference, discloses methods for the manufacture of helically crimped bicomponent polyester fibers suitable for use in this invention. The fibers produced by the method of that patent have a reversing helical crimp. Fibers having a reversing helical crimp are preferred over fibers that are crimped in a coiled configuration like a coiled spring. However, both types of helically crimped fibers are suitable for this invention. U.S. Pat. Nos. 3,868,749, 3,619,874, and 2,931,089, all of which are incorporated herein by reference, disclose various methods of edge crimping synthetic organic fibers to produce helically crimped fibers.

Helically crimped fibers typically and preferably have from about 1 to about 15 full cycle crimps per 25 mm fiber length, while stuffer box crimped fibers have about 3 to about 15 full cycle crimps per 25 mm fiber length. As taught in the '439 patent, when helically crimped fibers are used in conjunction with stuffer box crimped fibers, preferably the helically crimped fibers have fewer crimps per specified length than the stuffer box fibers.

Crimp index, a measure of fiber elasticity, preferably ranges from about 35 to about 70 percent for helically crimped fibers, which is about the same as stuffer box crimped fibers. Crimp index can be determined by measuring fiber length with appropriate "high load" attached, then subtracting fiber length with appropriate "low load" attached, and then dividing the result value by the high load fiber length and multiplying that value by 100. (The values of the appropriate "high load" and "low load" depend on the fiber denier. For fibers of the invention having 50 100 denier, low load is about 0.1–0.2 grams, high load is about 5–10 grams.) The crimp index can also be determined after exposing the test fibers to an elevated temperature, e.g., 135° C. to 175° C. for 5 to 15 minutes, and this value compared with the index before heat exposure. Crimp index measured after the fiber is exposed for 5 to 15 minutes to an elevate temperature, e.g., 135° C. to 175° C., should not significantly change from that measured before the heat exposure. The load can be applied either horizontally or vertically.

The length of the fibers employed is dependent on upon the limitations of the processing equipment upon which the nonwoven open web is formed. However, depending on types of equipment, fibers of different lengths, or combinations thereof, very likely can be utilized in forming the lofty open webs of the desired ultimate characteristics specified herein. Fiber lengths suitable for helically crimped fibers preferably range from about 60 mm to about 150 mm, whereas suitable fiber lengths for stuffer box fibers range from about 25 to about 70 mm.

Unlike other nonwoven abrasive products, the thickness (denier) of the fibers used in the nonwoven surface treating articles of the present invention is critical. As is generally known in the nonwoven abrasives field, larger denier fibers are preferred for more abrasive articles, smaller denier fibers are preferred for less abrasive articles, and fiber size must be suitable for lofty, open, low density abrasive products. Although the denier of fibers typically used for nonwoven abrasive articles may range broadly from about 6 to about 400, fiber size for nonwoven surface treating articles of the invention ranges from about 15 to about 200 denier, more preferably from about 50 to about 100 denier. Finer deniers than about 15 result in increased frictional drag when the nonwoven surface treating articles of this invention are attached to conventional floor machines (i.e., one designed to rotate and force the abrasive article against the surface and thus finish the surface). Fiber deniers larger than about 200 reduce drag, but torque from the floor machine may twist the web rather than rotate the web as is desired.

The nonwoven surface treating articles of the invention, when formed for use as floor pads for use in conventional floor machines, such as that commercially available, for example, from Miracle Sealants Company, El Monte, Calif., preferably have a non-compressed thickness of at least about 0.5 cm, more preferably ranging from about 2 cm to about 4 cm. As mentioned above, the thickness is dependent upon the fiber denier chosen for the particular application. If the fiber denier is too fine, the nonwoven surface treating articles of the invention will be less lofty and open, and thus thinner, resulting in the article tending to be more easily loaded with crystallization chemical and detritus from the floor or surface being treated.

Binder Compositions

Binders suitable for use in the nonwoven surface treating articles of the invention may comprise any thermoplastic or thermoset resin suitable for manufacture of nonwoven articles, but it will be clear to those skilled in the art of such manufacture that the resin in its final, cured state must be compatible (or capable of being rendered compatible) with the fibers of choice.

The cured resin preferably adheres to all of the types of fibers in a particular nonwoven article of the invention, thus deterring (preferably preventing) the subsequently made nonwoven surface treating article from becoming prematurely worn during use. In addition, cured resins suitable for use in the invention preferably adhere to the abrasive particles so as to prevent the particles from prematurely loosening from the nonwoven surface treating articles of the invention during use, but should allow the presentation of new abrasive particles to the surface being treated.

Another consideration is that the cured resin should be soft enough to allow the nonwoven surface treating articles of the invention to be somewhat flexible during use as a polishing or crystallization pad so as to allow the pad to conform to irregularities in the floor. However, the cured resin should not be so soft as to cause undue frictional drag between the nonwoven surface treating articles of the invention and the floor being treated. In the case of the articles of the invention being attached to a conventional electric floor polishing machine, high frictional drag may lead to increased amperage draw on the part of the floor machine and may cause electrical fuses to "blow" or circuit breakers to "trip".

Suitable resins will not readily undergo unwanted reactions, will be stable over a wide pH and humidity ranges, and will resist moderate oxidation and reduction. The cured resins should be stable at higher temperatures and have a relatively long shelf life.

The resins of the binders suitable for use in the nonwoven surface treating articles of the invention may comprise a wide variety of resins, including synthetic polymers such as styrene-butadiene (SBR) copolymers, carboxylated-SBR copolymers, melamine resins, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof.

One preferred group of resins useful in the present invention, particularly if a substantial number of the fibers of the nonwoven web are polyester, are terpolymeric latex resins formed by linear or branched copolymerization of a mixture of a non-functionalized monoethylenically unsaturated co-monomer, a functionalized monoethylenically unsaturated co-monomer, and a non-functionalized diethylenically unsaturated co-monomer. ("Functionalized", as used herein, means a monomer having a reactive moiety such as —OH, NH2, COOH, and the like, wherein "non-functionalized" means a monomer lacking such a reactive moiety.)

Particularly preferred terpolymer latex resins, used when the fibers of the nonwoven web are substantially polyester, are formed by random or block terpolymerization of styrene, butadiene, and a functionalized monoethylenically unsaturated monomer selected from the group consisting of monomers having the general formula $R^1R^2C{=}CR^3COOH$ and anhydrides thereof, wherein $R^1$ and $R^2$ are independently selected from H and $CH_3$, and $R^3$ is selected from H, $CH_3$ and COOH. In commercially available resins of this type, the amount of functionalized monoethylenically unsaturated monomer is typically proprietary, but is believed to be about 1 to about 10 mole percent of the total monomer. The mole percent of styrene ranges from about 50 percent to about 80 percent, more preferably from about 60 to about 70 percent, particularly preferably about 65 percent, as mole percentage of styrene and butadiene.

One commercially available and particularly preferred terpolymer latex resin is that sold under the tradename "AMSCO RES 5900", from Unocal. This aqueous latex resin is a terpolymer of styrene/butadiene/functionalized monoethylenically unsaturated monomer having styrene/butadiene mole ratio of 65/35, 1-10 mole percent of functionalized monoethylenically unsaturated monomer, solids weight percent of 50, pH of 9.0, anionic particle charge, particle size of 0.2 micrometer, and glass transition temperature of −5° C. Higher butadiene mole ratios produce a softer resin, but at the cost of greater drag. Typical and preferred coatable binder precursor solutions containing this latex resin and abrasive particles which are useful in forming cured binders are presented in Table A (wet parts by weight).

The above described terpolymers may be used uncross-linked, but they are preferably cross-linked by the reaction of the reactive COOH moiety with a polyfunctionalized monomer, such as a phenolic or melamine resin, as indicated in Table A.

Cross-linking resins, as mentioned in Table A, below, may be used to improve the water and solvent resistance of the ultimate nonwoven surface treating articles of the invention, and to increase their firmness. Melamine-formaldehyde resins, such as the fully methylated melamine-formaldehyde resins having low free methylol content sold under the trade designations "Cymel 301 ", 1133, and 1168, "Cymel 303" and "Aerotex M-3" (all currently available from American Cyanamid Company), and the like, are suitable. The former provides slightly higher tensile strength while the latter enhances stiffness and resilience of the nonwoven. Phenolic resins have also been used as cross-linking resins, such as those sold under the trade designations "433" (Monsanto) and "R-7" (Carborundum), and the like.

The latex resins useful in the present invention, if cross-linked, will have greater than 10% cross-linking, usually having in the range from about 15% to 80% cross-linking, more usually having in the range from about 25% to 60% cross-linking, and typically being in the range from about 45% to 55% cross-linking. The cross-linked latex resin particles may act as organic fillers, helping to smooth the coating of the fibers of the nonwoven webs with the linear or branched copolymers.

TABLE A

| | Preferred Binder Precursor Solutions | |
|---|---|---|
| Ingredient | Broad wt % Range | Preferred wt % Range |
| SBR latex (50% solids) | 20–40 | 25–35 |
| water | 2–10 | 2–6 |
| melamine-formaldehyde/crosslinking resin | 1–10 | 1–5 |
| garnet abrasive particles, 30 micrometers or less avg. part. size | 10–65 | 40–60 |
| catalyst (40% sol. of diammonium phosphate) | 0.1–0.5 | 0.1–0.3 |
| antifoam agent | 0.01–0.05 | 0.01–0.03 |
| surfactant | 0.1–1.0 | 0.1–0.5 |

The calculated or theoretical percentage of cross-linking is defined as the weight of polyfunctionalized monomer (or monomers) divided by the total weight of monomers.

Non-functionalized monoethylenically unsaturated monomers generally suitable for preparing linear, branched, and cross-linked latex resins useful herein include, styrene, ethylvinylbenzene, and vinyltoluene, with styrene being particularly preferred.

Diethylenically unsaturated monomers useful in the invention include isopropene, butadiene and chloroprene, with butadiene being particularly preferred.

If the nonwoven abrasive articles comprise a substantial amount of polyamide (e.g., nylon 6,6) fibers, other resins may be preferred as the resin component of the binder. Examples of suitable binders for use when the fibers comprise polyamides include: phenolic resins, aminoplast resins, urethane resins, urea-aldehyde resins, isocyanurate resins, and mixtures thereof. One preferred resin is a thermally curable resole phenolic resin, such as described in Kirk-Othmer, *Encyclopedia of Chemical Technology*, 3rd Ed., John Wiley & Sons, 1981, N.Y., Vol. 17, p. 384–399, incorporated by reference herein.

Examples of commercially available phenolic resins include those known by the trade names "Varcum" and "Durez" (from Occidental Chemicals Corp., N. Tonawanda, N.Y.), and "Arofene" (from Ashland Chemical Co.). The resole phenolic resin of choice has about 1.7:1 formaldehyde to phenol weight ratio, 76 weight percent solids.

In one preferred method for making the nonwoven surface treating articles of the invention, a coatable binder precursor solution, comprising uncured resin, abrasive particles, and other ingredients, such as thickeners, depending on the coating procedure, is applied to a nonwoven web using two-roll coating. Then, during further processing, the binder precursor is cured or polymerized to form a cured binder. Other coating methods may of course be employed as are known in the art, such as spray coating, and the like. The binder precursor solution may be alternatively applied to the web without abrasive particles in the solution, with the abrasive particles electrostatically or mechanically deposited onto the web. However, it is preferred to mix the micro-abrasive particles used in the invention with the binder precursor solution to prevent unnecessary dust hazards.

Binder precursor solutions and cured binders suitable for use in the invention may contain appropriate curing agents, non-abrasive fillers, pigments, and other materials which are desired to alter the final properties of the nonwoven surface treating articles of the invention. In particular, in the floor finishing field, the color of the nonwoven surface treating articles serves to characterize the article (white being the least abrasive, darker colors indicating more abrasive). Thus, the resins, binder precursor solutions, and binders useful in the invention are preferably compatible or capable of being rendered compatible with pigments.

Another method of making the articles of the invention comprises using abrasive filaments as the fibers of the nonwoven web (i.e., filaments having abrasive particles adhered thereto). Abrasive filaments such as those disclosed in assignee's copending application Ser. Nos. 07/853,799 and 07/854,330, filed Feb. 19, 1992, are suitable abrasive filaments.

Another aspect of the invention is a system capable of crystallizing surfaces comprising calcium carbonate, the system comprising the nonwoven surface treating articles of the invention in combination with an acidic crystallization agent.

The acidic crystallization agent typically comprises standard chemicals used in the art, and comprises at least one chemical capable of reacting with the calcium carbonate in the surface to be treated. Typical and preferred acidic crystallization solutions are commercially available, such as, for example, the crystallizer formulations known under the trade designations "Terranova" (from S. C. Johnson and Sons, Inc.); "Terrazzo Treat" (available from Balmforth Cleaning Services); "Kleever" and "Coor" (from Kleever & Coor S.A.); and "VMC-Pink" (available from Verona Marble Company, Dallas, Tex.). These commercially available crystallizing agents all contain magnesium hexafluorosilicate ($MgSiF_6$) as the active crystallizing agent, although zinc hexafluorosilicate salt can be used as a crystallizing agent. Other acidic crystallizing agents include hydrofluoric acid (HF) and oxalic acid.

A typical acidic crystallizing agent useful in the present invention comprises from about 2 to about 20 weight percent of a chemical reactive with the calcium in the surface comprising calcium, with the balance being water and minor amounts of thickening agents, surfactants, and the like.

One commercially available crystallizing agent, mentioned above, sold under the trade designation "VMC-Pink", (available from Verona Marble Company, Dallas, Tex.), comprises from about 2 weight percent to about 30 weight percent magnesium hexafluorosilicate, with balance being water, surfactant, and a wax.

Method of Crystallizing Marble Floors

The method of the invention comprises treating a stone surface which comprises calcium carbonate, for example marble, by applying (preferably spraying) an acidic crystallization agent either to the marble surface or to a nonwoven surface treating article of the invention, the acidic crystallization agent comprising a chemical capable of reacting with the calcium in the marble to produce an insoluble calcium salt. The nonwoven surface treating article of the invention is then contacted to the marble surface in the presence of the acidic crystallization agent while creating relative movement between the surface and the nonwoven article, thereby producing a durable, high gloss surface on the calcium carbonate-containing surface.

As stated above, the crystallization agent is applied (preferably sprayed) either on to the surface to be treated, the nonwoven surface treating article of the invention, or both. The articles of the invention are preferably attached to a conventional floor machine adapted to operate at low speed (100–200 rpm), having heavy weights attached thereto. The total weight of machine and weights preferably ranges from about 45 to about 135 kg, more preferably from about 70 to about 90 kg. The exact machine, pad, rotary buffing speed, and weight are not critical to the practice of the invention, but as is well known in the art a heavier machine results in a higher gloss on a finished surface after the crystallization agent is applied. In the case of conventional floor machines, the non-woven surface treating articles of the invention will preferably have a diameter ranging from about 25 to about 75 cm, more preferably ranging from about 40 to about 50 cm.

Surfaces which may be treated in accordance with the method of the invention include marble, terrazzo, magnesite, and others, as listed in the background of the invention. Essentially any calcium carbonate-containing surface which effervesces upon the application of a dilute hydrochloric acid solution can be crystallized using the articles, system, and method of the present invention.

In the Test Procedures and Examples which follow, all parts and percentages are by weight. "APS" refers to average particle size.

TEST PROCEDURES

Schiefer Gloss

In order to reduce the number of variables inherent with on-the-floor tests and to attempt to ensure more consistent and operator invariant results, a bench-top test method was developed for determining the efficacy of a particular marble treatment procedure in obtaining high gloss finishes.

A Schiefer abrasion machine (manufactured by Frazier Precision Co., Gaithersberg, Md.) as described in ASTM D 4158-82, "Abrasion Resistance of Textile Fabrics", Section 6 and FIGS. 1 and 2, was modified by replacing the upper abradant support and the lower specimen support with flat stainless steel discs having 10.2 Cm diameter (upper) and 12.7 cm diameter (lower), respectively each being 0.48 cm thick. Onto the lower support was permanently attached a durable clear plastic template having a centrally located square cut-out which held in place (without further attachment means) marble test tiles having dimensions 7.6 cm ×7.6 cm ×0.95 cm, such that the tiles were centered with respect to the lower support axis of rotation. Onto the upper support was permanently attached a 10.2 cm disc of attachment material (known under the trade designation "Insta-Lok", from 3M, described in U.S. Pat. No. 3,527,001) which functioned to hold in place 9.53 cm diameter test pad samples which were mounted such that they were centered with respect to the upper support axis of rotation.

In accordance with ASTM D 4158-82, FIG. 1, the centers of rotation of the two supports were not colinear, but were horizontally displaced approximately 2.54 cm. The rotation of the two discs was in the same direction; the rotational speed of each disc was approximately 250 rpm, but was slightly different thus causing shear between the two resulting in a polishing action. Because the supports were horizontally offset, the test pads overlapped the marble test tiles a little less than half way.

In order to create a similar polishing environment commonly used on marble floors, i.e., floor machines carrying extra "saddle" weights to provide additional force on the floor during the marble polishing or crystallizing steps, a 4.54 kg weight was used on the Schiefer machine.

The test procedure was as follows: marble test tiles were pretreated (dulled) by grinding with 120 grade abrasives ("ScotchMesh", from 3M) for 500 cycles prior to testing in order to produce a uniform and reproducible starting surface on the marble test tiles having less than 5 glossmeter reading at any angle. Into the template was placed a marble test tile, and a test pad was affixed to the upper support. If desired, 0.2 gram of crystallization chemical was spread onto the marble test tile. Then the upper support was lowered such that the test pad and the marble test tile came into contact bearing the full force of the affixed weights, and the machine was operated for 500 revolutions. The preceding operations define "one cycle" of testing. After one or more buffing cycles, the marble test tile in each case was removed from the Schiefer machine, rinsed with water, and wiped dry.

The 20° and 60° glossmeter geometry gloss measurements, five per sample, were made after buffing, and the average of these recorded. Test method ASTM D-523 was followed for determining specular gloss values. Note that "60° glossmeter geometry gloss" value (i.e., incident light reflected from the test surface at incident angle measured 60 ° from vertical) relates to the "shininess" of the surface and correlates to the appearance of the floor about 3 meters in front of the observer. A "20° glossmeter geometry gloss" value relates to the depth of the reflection and correlates to the appearance of the floor about 60 cm in front of the observer. A reading off a glossmeter is an indexed value, with a value of "100" given to the glossmeter reading (from any angle) from a highly polished, plane, black glass with a refractive index of 1.567 for the sodium D line. The incident beam is supplied by the tester itself. A value of 0 is no or very low gloss, while "high gloss" at 60° geometry is about 75 or greater (or 30 or greater at 20° geometry), which are preferred. A glossmeter known under the trade designation "Micro-TRI", from BYK Gardner, was used.

Gardner Durability

The principle mode of wear on a polished marble floor is abrasion from foot traffic. While some data may be obtained from an actual floor by counting the number of pedestrians traversing the floor during a given period of time and measuring the gloss of the floor as a function of the amount of traffic, variability of the results is introduced by the amount and type of soil present on the feet of the pedestrians, factors which vary with the weather among other things. Such testing requires a great deal of time on most floors—perhaps several months—in order to achieve meaningful results. We therefore have resorted to a relatively simple durability test which can be done quickly in the laboratory.

The polished marble tiles form the Schiefer gloss tests were mounted onto the fixed bed of a durability tester known under the trade designation "Gardner Abrasion Tester" (Pacific Scientific, Calif.). This machine essentially comprised a horizontal surface to which the polished marble test tiles were attached, and a reciprocating holder for a nonwoven surface treating article. A white nonwoven pad (trade designation "Scotch-Brite Super Polish", from 3M) was attached to the reciprocating holder so that the pad rubbed across the polished marble test tile. The weight of the holder was approximately 500 g. Twenty five grams of a 10% slurry of 12 micron calcium carbonate (trade designation "Gammasperse 960", from Georgia Marble Co.) in water was placed on the surface of the polished marble test tile. The machine was run for 50 cycles thus causing abrasion of the surface of each polished marble test tile. The tile sample was then removed from the machine, rinsed with deionized water, and blotted dry in each case. Finally, the tiles were dried with a hot air blower ("heat gun" ) at its hot setting for one minute. Five gloss measurements were taken at 20 degrees and at 60 degrees with the gloss tester described above. The readings were averaged, recorded, and compared with the initial gloss readings from the polished marble test tiles. The lower the drop in gloss, the more durable the surface.

EXAMPLE 1 and COMPARATIVE EXAMPLE A

A low density prebonded nonwoven web was formed by a conventional web making machine (trade designation "Rando Webber"). The web formed was a blend of fibers comprising 75 weight percent of 84 mm long, 100 denier helically crimped PET polyester staple fibers having crimp index of 49%, and 25 weight percent of 58 mm long, 25 denier crimped sheath-core melt-bondable polyester staple fibers (core comprising polyethylene terephthalate, sheath comprising copolyester of ethylene terephthalate and isophthalate) having about 5 crimps per 25 mm and a sheath weight of about 50 percent. The formed web was heated in a hot convection oven for about three minutes at 160° C. to bond the melt-bondable fibers together at points of intersection to form a prebond web. The prebonded web weighed about 420 g/m$^2$.

A binder precursor solution was prepared having about 77% by weight of non-volatile materials by combining the ingredients in the amounts indicated in Table 1:

TABLE 1

| INGREDIENT | (parts by weight) |
|---|---|
| Water | 4.0 |
| SBR latex ("AMSCO RE 5900") | 32.2 |
| melamine resin ("Cymel 303") | 3.2 |
| 7 micrometer avg. part. size garnet ("Barton W7F")[1] | 60.0 |
| Diammonium phosphate, 40 wt % in water | 0.2 |
| antifoam ("DC Q2-3168")[2] | 0.02 |

TABLE 1-continued

| INGREDIENT | (parts by weight) |
|---|---|
| surfactant ("Triton GR-5M")[3] | 0.4 |

[1]"Barton W7F" garnet micro-abrasive is commercially available from Barton Mines Corporation, North Creek, N.Y
[2]"DC Q2-3168" is a silicone emulsion surfactant available from Dow Corning
[3]"Triton GR-5M" is a dioctyl sodium sulfosuccinate surfactant available from Rohm and Haas The binder precursor solution was applied to the prebond web by passing the prebond web between a pair of vertically opposed, rotating, 250 mm diameter rubber covered squeeze rollers. The rotating lower roll, which was immersed in the binder precursor solution, carried the solution to the prebond web so as to evenly disperse it throughout the web structure. The wet prebond web was dried and the saturant cured in a hot air oven at about 175° C. for about five to seven minutes. The dry, coated prebond web weighed about 1800 g/m$^2$ and exhibited a tensile strength of about 0.7 MPa as determined on a standard tensile testing machine ("Instron" model TM).

The coated nonwoven web of this example was then cut into 10.2 cm diameter disks and tested for gloss production on the Schiefer machine using three commercially available crystallizing chemicals—those known under the trade designations "Kleever K2" (from Kleever), "Terranova" (S.C. Johnson Company, Racine, Wis.), and "VMC-Pink" (Verona Marble Company, Dallas, Tex.).

For comparison, Comparative Example A, consisting of #1 steel wool (the specified grade of steel wool in the Kleever literature) was tested. After four cycles on the Schiefer machine, the material of Example A, independent of the crystallizing chemical used, yielded a 60 degree gloss comparable or slightly greater than the steel wool when tested on white Calcutta marble, and a 20 degree gloss approximately 25-35% higher than that produced by the steel wool. On a softer travertine marble, the results were approximately equivalent regardless of gloss angle or crystallizing chemical.

EXAMPLE 2-5 and COMPARATIVE EXAMPLE B

Prebond nonwovens were made as in Example 1 except that the abrasive particle content of the final article is as shown in Tables 2 and 3:

TABLE 2

| INGREDIENT | (parts by weight) | | |
|---|---|---|---|
| Water | 10.0 | 8.8 | 7.6 |
| SBR latex ("AMSCO RES 5900") | 56.0 | 50.0 | 42.0 |
| melamine resin ("Cymel 303") | 6.0 | 5.2 | 4.6 |
| abrasive (see Table 3) | 20.0 | 30.0 | 40.0 |
| diammonium phosphate (40 wt % in water) | 0.8 | 0.6 | 0.4 |
| thickener ("Methocel F4M", 3 wt % in water)* | 6.2 | 5.4 | 4.6 |
| antifoam ("DC Q2-3168") | 0.08 | 0.08 | 0.06 |
| surfactant ("Triton GR-5M") | 1.0 | 1.0 | 0.8 |

*"Methocel F4M" is a hydroxypropylmethylcellulose commercially available from Dow Chemical Company

TABLE 3

| EXAMPLE | ABRASIVE MINERAL | CONTENT |
|---|---|---|
| 2 | 7 micrometer APS garnet ("Barton W7F") | 20% |
| 3 | 7 micrometer APS garnet ("Barton W7F") | 40% |
| 4 | 0.3 micrometer APS aluminum oxide | 30% |
| 5 | 9 micrometer APS aluminum oxide | 20% |

TABLE 3-continued

| EXAMPLE | ABRASIVE MINERAL | CONTENT |
|---|---|---|
| CTRL B | talc ("C-400")* | 40% |

*"C-400" talc is available from Cyprus Industrial Minerals Co., Three Forks, Montana The abrasive pads of Examples 2-5 yielded a very high gloss (i.e., much greater than 75) at 60° by the Schiefer test on white Calcutta marble samples when tested by the procedures used in Example 1, with "Kleever K2" crystallization solution. Comparative Example B samples produced moderate-to-high gloss values.

EXAMPLE 6 and 7

Two identical low density prebonded nonwoven webs were made by forming on a conventional web making machine (trade designation "Rando Webber"). The web formed was a blend of fibers comprising 75% by weight of 53 mm long, 70 denier stuffer-box crimped nylon 6,6 staple fibers having crimp index of about 27% and 25% by weight of 58 mm long, 25 denier crimped sheath-core melt-bondable polyester staple fibers (same construction as Example 1) having about 5 crimps per 25 mm and a sheath weight of about 50 percent. The webs were heated in a hot air convection oven for 3 minutes at 160° C. to bond the melt-bondable fibers together at points of intersection to form prebond webs. The prebonded webs of Examples 6 and 7 each weighed about 35 g/m$^2$.

A binder precursor solution including a resole phenol-formaldehyde resin having about 70% by weight solids, and a formaldehyde/phenol weight ratio of about 1.7:1 was made by combining the ingredients listed in Table 4.

TABLE 4

| INGREDIENT | AMOUNT (parts by weight) EX. 6 | EX. 7 |
|---|---|---|
| Water | 30.3 | 15.3 |
| Phenol-formaldehyde resin | 29.5 | 21.2 |
| garnet ("Barton W7F") | 39.8 | 63.6 |
| silicon dioxide ("Cabosil M5")* | 0.4 | — |

*"Cabosil M5" silicon dioxide is commercially available from Cabot Corp.

The binder precursor was applied to the prebond webs in each of Examples 6 and 7 by the same method as used in Example 1. The wet prebond webs, each weighing approximately 2,110 g/m$^2$, were dried and the binder precursor solution cured in a hot air convection oven at about 175° C. for about ten to twelve minutes.

The nonwoven surface treating articles of Examples 6 and 7 produced a gloss on the Schiefer machine test (with the crystallization chemical known under the trade designation "Kleever K2") that was equivalent to that of Examples 1 and 3, respectively, under the same conditions.

What is claimed is:

1. A nonwoven surface treating article suitable for treating stone surfaces comprised of calcium carbonate with crystallizing chemicals to improve the gloss thereof the article comprising an open, lofty, three-dimensional nonwoven web comprising a plurality of thermoplastic organic fibers, a binder which adheres said fibers at points of mutual contact, and abrasive particles adherently bonded to the fibers by said binder, the abrasive particles having an average particle diameter ranging from about 0.1 micrometer to about 9 micrometers.

2. The article of claim 1 wherein said fibers are selected from the group consisting of stuffer-box crimped fibers, helically crimped fibers, melt-bondable fibers, and combinations thereof.

3. The article of claim 2 wherein said stuffer-box fibers and helically crimped fibers comprise polymers selected from the group consisting of polyester, rayon, nylon, and wherein the melt-bondable fibers comprise a first component comprising an oriented, crimpable, at least partially crystallized polymer, and adhering to the surface of said first component a second component which comprises a compatible blend of polymers, and combinations thereof.

4. The article of claim 2 wherein the melt-bondable fibers comprise up to about 50 weight percent of the web.

5. The article of claim 3 wherein the web comprises helically crimped polyethylene terephthalate polyester staple fibers and wherein the melt-bondable fiber comprises a polyester.

6. The abrasive article of claim 1 wherein the abrasive particles comprise materials selected from the group consisting of silicon carbide, fused aluminum oxide, heat treated fused aluminum oxide, alumina zirconia, cubic boron nitride, garnet, pumice, sand, emery, mica, corundum, quartz, diamond, boron carbide, fused alumina, sintered alumina, alpha alumina-based ceramic material, and combinations thereof.

7. The abrasive article of claim 1 wherein the web has a non-compressed thickness ranging from about 0.5 cm to about 4.0 cm.

8. The abrasive article of claim 1 wherein the fibers have a denier ranging from about 15 to about 200, and a length ranging from about 2.0 cm to about 4.0 cm.

9. The abrasive article of claim 2 wherein the helically crimped fibers have from about 1 to about 25 crimps per mm.

10. An abrasive article in accordance with claim 1 wherein the binder comprises an organic material comprising polymers selected from the group consisting of phenolic resins, acrylic-based resins, melamine resins, urea-aldehyde resins, and a latex comprising the copolymerization product of at least one non-functionalized monoethylenically unsaturated monomer, at least one diethyleneically unsaturated monomer, and at least one functionalized monoethylenically unsaturated monomer.

11. An abrasive article in accordance with claim 10 wherein the non-functionalized monoethylenically unsaturated monomer comprises styrene, the diethylenically unsaturated monomer comprises butadiene, and the functionalized monoethylenically unsaturated monomer is selected from the group consisting of monomers having the general formula $R^1R^2C{=}CR^3COOH$ and anhydrides thereof, wherein $R^1$ and $R^2$ are independently selected from H and $CH_3$, and $R^3$ is selected from H, $CH_3$ and COOH.

12. An abrasive article in accordance with claim 11 wherein the non-functionalized monoethylenically unsaturated monomer is styrene and said diethylenically unsaturated monomer is butadiene.

13. An abrasive article in accordance with claim 12 wherein the mole percent of styrene ranges from about 50 percent to about 80 percent.

14. An abrasive article in accordance with claim 1 wherein the fibers comprise nylon and the binder comprises a phenolic resin.

15. A system for polishing and/or crystallizing surfaces comprised of calcium carbonate, such as marble floors, the system comprising:

(a) An abrasive article comprising an open, lofty, three-dimensional non-woven web comprising a plurality of thermoplastic organic fibers, a binder which adheres said fibers at points of mutual contact, and abrasive particles adherently bonded to the fibers by said binder, the abrasive particles having an average particle diameter ranging from about 0.1 micrometer to about 30 micrometers; and (b) an acidic crystallization agent comprising a chemical capable of reacting with the calcium in the surface comprising calcium carbonate to produce an insoluble calcium salt.

16. A system in accordance with claim 15 wherein the acidic crystallization agent comprises a hexafluorosilicate salt.

17. A system in accordance with claim 15 wherein the acidic crystallization agent comprises oxalic acid.

18. A system for polishing and/or crystallizing surfaces comprised of calcium carbonate, such as marble floors, the system comprising:

(a) an abrasive article comprising an open, lofty, three-dimensional non-woven web comprising a plurality of thermoplastic organic fibers selected from the group consisting of stuffer box crimped fibers, helically crimped fibers, melt-bondable fibers, and combinations thereof, a binder which adheres said fibers at points of mutual contact, and abrasive particles adherently bonded to the fibers by said binder, the abrasive particles having an average particle diameter ranging from about 0.1 micrometer to about 30 micrometers; and (b) an acidic crystallization agent comprising a chemical capable of reacting with the calcium in the surface comprised of calcium carbonate to produce an insoluble calcium salt.

19. A method of treating a surface comprised of calcium carbonate, said method comprising:

(a) applying an acidic crystallization agent either to said surface or to a nonwoven surface treating article, or both the surface and the article, the acidic crystallization agent comprising a chemical capable of reacting with the calcium in the calcium in the surface to produce an insoluble calcium salt, the nonwoven surface treating article comprising an open, lofty, three-dimensional nonwoven abrasive web comprising a plurality of thermoplastic organic fibers, a binder, and abrasive particles having an average particle diameter ranging from about 0.1 micrometer to about 30 micrometers; and (b) contacting said nonwoven surface treating article with said surface while creating relative movement between the surface and the nonwoven surface treating article, thereby producing a durable, high gloss finish on the surface.

* * * * *

UNITED STATES PATENT AND TRADEMARK OFFICE

CERTIFICATE OF CORRECTION

PATENT NO. : 5,282,900

DATED : February 1, 1994

INVENTOR(S) : McDonell et al.

It is certified that error appears in the above-identified patent and that said Letters Patent is hereby corrected as shown below:

Col. 20, line 32 "35 $g/m^2$." should be --635 $g/m^2$.--

Signed and Sealed this

Fifth Day of July, 1994

*Attest:*

*Attesting Officer*

BRUCE LEHMAN

*Commissioner of Patents and Trademarks*